US006663176B1

(12) United States Patent
Tull

(10) Patent No.: US 6,663,176 B1
(45) Date of Patent: Dec. 16, 2003

(54) SEATING DEVICE

(76) Inventor: Sharon V. Tull, 311 Eagle Point Cir., Apt. B 5, Liverpool, NY (US) 13090

( * ) Notice: Subject to any disclaimer, the term of this patent is extended or adjusted under 35 U.S.C. 154(b) by 0 days.

(21) Appl. No.: 10/108,322

(22) Filed: Mar. 28, 2002

(51) Int. Cl.[7] ..... A47D 15/00; A47C 16/04; A47C 4/00; A47C 7/00; B60N 2/02

(52) U.S. Cl. ..... 297/182; 297/188.06; 297/53; 297/35; 297/378.1; 297/440.2

(58) Field of Search ..... 297/54, 53, 35, 297/40, 182, 283.3, 284.1, 378.1, 440.2, 440.21

(56) References Cited

U.S. PATENT DOCUMENTS

| | | | | | |
|---|---|---|---|---|---|
| 2,474,572 | A | * | 6/1949 | Brose et al. | 4/523 |
| 2,985,889 | A | | 5/1961 | Fain et al. | |
| D220,098 | S | | 3/1971 | Molle | |
| 3,879,085 | A | * | 4/1975 | Morel | 297/182 |
| 4,167,048 | A | | 9/1979 | Williams | |
| 4,240,662 | A | | 12/1980 | Anderson | |
| D267,599 | S | | 1/1983 | Fator | |
| 4,948,197 | A | | 8/1990 | Sansing | |
| 5,328,246 | A | * | 7/1994 | Sereboff | 297/411.36 |
| D396,983 | S | * | 8/1998 | Taylor | D6/611 |

* cited by examiner

*Primary Examiner*—Peter M. Cuomo
*Assistant Examiner*—Sarah C. Burnham

(57) ABSTRACT

A seating device for positioning adjacent to a bathtub for shampooing a child's hair. The seating device includes a seat section for supporting a buttocks of the child coupled to a back section for supporting a back of the child. A plurality of leg members is provided for supporting the seat section above a surface. A first end of each of the leg members is coupled to the seat section. A drape is provided for guiding water from the child's hair into the bathtub. A first end of the drape is removably mounted on an upper edge of the back section and a second end of the drape is removably positionable in the bathtub.

16 Claims, 5 Drawing Sheets

SEATING DEVICE

BACKGROUND OF THE INVENTION

1. Field of the Invention

The present invention relates to chairs and more particularly pertains to a new seating device for positioning adjacent to a bathtub for shampooing a child's hair.

2. Description of the Prior Art

The use of chairs is known in the prior art. More specifically, chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,984,197; U.S. Pat. No. 4,240,662; U.S. Pat. No. 4,167,048; U.S. Pat. No. 2,985,889; U.S. Pat. No. Des. 267,599; and U.S. Pat. No. Des. 200,098.

While these devices fulfill their respective, particular objectives and requirements, the aforementioned patents do not disclose a new seating device. The inventive device includes a seat section for supporting a buttocks of the child coupled to a back section for supporting a back of the child. A plurality of leg members is provided for supporting the seat section above a surface. A first end of each of the leg members is coupled to the seat section. A drape is provided for guiding water from the child's hair into the bathtub. A first end of the drape is removably mounted on an upper edge of the back section and a second end of the drape is removably positionable in the bathtub.

In these respects, the seating device according to the present invention substantially departs from the conventional concepts and designs of the prior art, and in so doing provides an apparatus primarily developed for the purpose of positioning adjacent to a bathtub for shampooing a child's hair.

SUMMARY OF THE INVENTION

In view of the foregoing disadvantages inherent in the known types of chairs now present in the prior art, the present invention provides a new seating device construction wherein the same can be utilized for positioning adjacent to a bathtub for shampooing a child's hair.

The general purpose of the present invention, which will be described subsequently in greater detail, is to provide a new seating device apparatus and method which has many of the advantages of the chairs mentioned heretofore and many novel features that result in a new seating device which is not anticipated, rendered obvious, suggested, or even implied by any of the prior art chairs, either alone or in any combination thereof.

To attain this, the present invention generally comprises a seat section for supporting a buttocks of the child coupled to a back section for supporting a back of the child. A plurality of leg members is provided for supporting the seat section above a surface. A first end of each of the leg members is coupled to the seat section. A drape is provided for guiding water from the child's hair into the bathtub. A first end of the drape is removably mounted on an upper edge of the back section and a second end of the drape is removably positionable in the bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new seating device apparatus and method which has many of the advantages of the chairs mentioned heretofore and many novel features that result in a new seating device which is not anticipated, rendered obvious, suggested, or even implied by any of the prior art chairs, either alone or in any combination thereof.

It is another object of the present invention to provide a new seating device which may be easily and efficiently manufactured and marketed.

It is a further object of the present invention to provide a new seating device which is of a durable and reliable construction.

An even further object of the present invention is to provide a new seating device which is susceptible of a low cost of manufacture with regard to both materials and labor, and which accordingly is then susceptible of low prices of sale to the consuming public, thereby making such seating device economically available to the buying public.

Still yet another object of the present invention is to provide a new seating device which provides in the apparatuses and methods of the prior art some of the advantages thereof, while simultaneously overcoming some of the disadvantages normally associated therewith.

Still another object of the present invention is to provide a new seating device for positioning adjacent to a bathtub for shampooing a child's hair.

Yet another object of the present invention is to provide a new seating device which includes a seat section for supporting a buttocks of the child coupled to a back section for supporting a back of the child. A plurality of leg members is provided for supporting the seat section above a surface. A first end of each of the leg members is coupled to the seat section. A drape is provided for guiding water from the child's hair into the bathtub. A first end of the drape is removably mounted on an upper edge of the back section and a second end of the drape is removably positionable in the bathtub.

Still yet another object of the present invention is to provide a new seating device that allows a user to more easily wash the hair of a child without having to undress the child and place them in a bathtub.

Even still another object of the present invention is to provide a new seating device that allows a child to tilt their head back while their hair is being washed, thus preventing shampoo from getting in the child's eyes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
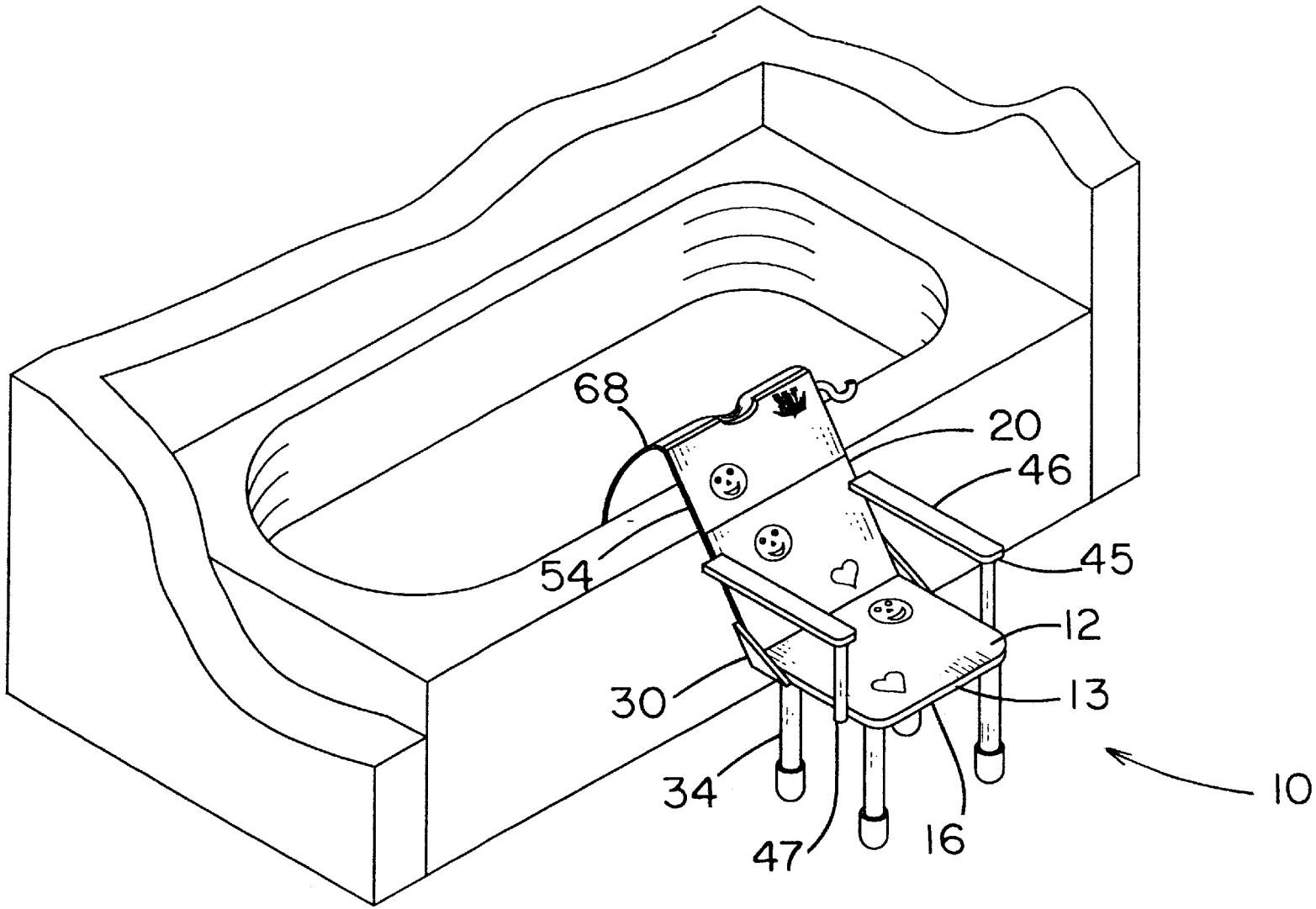
FIG. 1 is a schematic perspective view of a new seating device according to the present invention.

With reference now to the drawings, and in particular to FIGS. 1 through 6 thereof, a new seating device embodying the principles and concepts of the present invention and generally designated by the reference numeral 10 will be described.

As best illustrated in FIGS. 1 through 6, the seating device generally comprises a substantially planar seat section 12 and a back section 20 coupled to a plurality of leg members 34 for supporting a child above a surface while they are getting their hair washed.

The seat section 12 is provided for supporting a buttocks of the child. The seat section 12 includes a front edge 13, a back edge 14 and a pair of lateral side edges 15. As particularly illustrated in FIG. 5, a lower surface 16 of the seat section 12 may include a plurality of spaced ear portions 18 formed thereon. Each of the spaced ear portions 18 is preferably positioned generally adjacent to a corner of the seat section 12.

The back section 20 is provided for supporting a back of the child. The back section 20 includes an upper edge 21, a lower edge 22 and a pair of side edges 23. The lower edge 22 of the back section 20 may be pivotally coupled to the back edge 15 of the seat section 12 and may be, as particularly illustrated in FIGS. 1 and 5, positionable between an upright position and a folded position. In one embodiment of the present invention, the upright position is characterized by the back section 20 being orientated generally perpendicular to the seat section 12. The folded position is characterized by the back section 20 being orientated generally parallel to the seat section 12. The back section 20 may include a pair of protruding portions 25 and an elongated channel portion 26 formed thereon.

In one embodiment of the present invention, each of the protruding portions 25 may be formed on each of the side edges 23 and positioned generally nearer the lower edge 22 than the upper edge 21 of the back section 20. The elongated channel portion 26 may be formed on a back surface 27 of the back section 20 and extend between the upper 21 and lower 22 edges of the back section 20.

A pair of brackets 30 may be provided for supporting the back section 20 in the upright position when a weight of the child is placed upon the back section 20. Each of the brackets 30 may be mounted on one of the lateral edges 14 of the seat section 12. An inner surface 31 of each of the brackets 30 preferably include a generally arcuate groove 32 therein with each of the protruding portions 25 of the back section 20 being slidably mounted in one of the grooves 32. Each of the brackets 30 may have a generally obtuse triangular shape, however other shapes may be employed.

The plurality of leg members 34 are provided for supporting the seat section 12 above a surface. Each of the leg members 34 includes a first end 35 and a second end 36. The first end 335 of each of each of the leg members 34 may be pivotally coupled to one of the spaced ear portions 18 of the seat section 12. Each of the leg members 34 is preferably orientated generally perpendicular to the seat section 12 in the upright position and orientated generally parallel to the seat section 12 in the folded position.

The present invention may include a plurality of caps 38 for resisting slipping of the second end 36 of each of the leg members 34 with respect to a surface such as bathroom floor. Each of the caps 38 may be removably mounted on the second end 36 of each of the leg members 34. An edge 39 of each of the caps 38 defines an opening 40 into each of the caps 38. The second end 36 of each of the leg members 34 may be removably inserted in one of the openings 40 of the plurality of caps 34. As particularly illustrated in FIG. 3, an end 42 of each of the caps 38 may include an annular flange 43 formed thereon for securing each of the caps 38 to the surface. The annular flange 43 may act as a suction cup on the floor surface, ensuring that each of the leg members 34 will not slip with respect to the floor surface.

A pair of arm members 45 may be provided for each supporting an arm of the child. Each of the arm members 45 preferably includes an arm portion 46 and a support portion 47 that are pivotally coupled together. In one embodiment of the present invention, as particularly illustrated in FIG. 5, the arm portion 46 has a first end 48 and a second end 49. The first end 48 of the arm portion 46 may be s pivotally coupled to the side edge 23 of the back section 20. The arm portion 46 is preferably orientated generally parallel to the seat section 20.

The support portion 47 has a first end 50 and a second end 51. The first end 50 of the support portion 47 may be pivotally coupled to the lateral side edge 14 of the seat section 20 while the second ends 49 and 51 of the arm portion 46 and the support portion 47 are pivotally coupled together. In one embodiment of the present invention, the arm portion 46 and the support portion 47 are orientated generally perpendicular to each other in the upright position and parallel to each other in the folded position.

A substantially planar head section 54 may be provided for selectively receiving a head of the child. The head section 54 may include a head portion 55 and an elongated connecting portion 56 coupled together. In one embodiment of the present invention, the head portion 55 has an upper edge 58, a lower edge 59 and a pair of lateral edges 60. The upper edge 58 of the head portion 55 may include a generally arcuate cutaway 61 therein for selectively supporting a neck of a child tilting their head in a backward direction. The cutaway 61 is preferably positioned generally an equal distance between each of the lateral edges 60 of the head portion 55.

The connecting portion 56 has a first end 62 and a second end 63. The first end 62 of the connecting portion 56 is preferably mounted on a back surface 88 of the head portion 55. The second end 63 of the connecting portion 56 is slidably mounted in the channel portion 26.

A substantially planar spacer section 64 may be removably positioned between the lower edge 59 of the head portion 55 and the upper edge 21 of the back section 20 for extending the head portion 55 for taller children. A back surface 65 of the spacer section 64 may include a groove 66 therein. The connecting portion 56 is removably mounted in the groove 66 of the spacer section 64.

A hook member 67 may be mounted on one of the lateral side edges 60 of the head portion 55 for hanging such things as a towel to be used for drying a child's hair. The hook member 67 may be positioned generally adjacent to the upper edge 58 of the head portion 55. The hook member 67 may comprise a substantially rigid material such as, for example, a wood, steel or metal material.

A drape 68 is provided for guiding water from the child's hair into the bathtub. The drape 68 preferably includes a first end 69 and a second end 70. The first end 69 of the drape 68 is removably mounted on the upper edge 58 of the head portion 55 with the second end 70 of the drape 68 being removably positionable in the bathtub. The first end 69 of the drape 68 may include a cutaway 71 therein and positioned generally adjacent to the cutaway 61 in the head portion 55 when the drape 68 is mounted on the head portion 55. The drape 68 may comprise a generally flexible material such as, for example, a plastic or cloth material.

A fastening member 72 may be provided for removably fastening the drape 68 to the head portion 55. The fastening member 72 may include a pair of fastening portions 73. One of the fastening portions 73 may be mounted on the first end 69 of the drape 68 and one of the fastening portions 73 may be mounted on the upper edge 58 of the head portion 55. Each of the fastening portions 73 is preferably releasably coupled together. The fastening member 72 may comprise a hook and loop fastener, however, other types of fasteners may be employed.

A pair of magnets 74 may be provided for securably mounting the second end 70 of the drape 68 to the bathtub. Each of the magnets 74 may be mounted on an inner surface 75 of the drape 68 and positioned generally adjacent to the second end 70 of the drape 68. Each of the magnets 74 is magnetically attracted to an inner surface of the bathtub for holding the second end 70 of the drape 68 in place.

Figure 3:
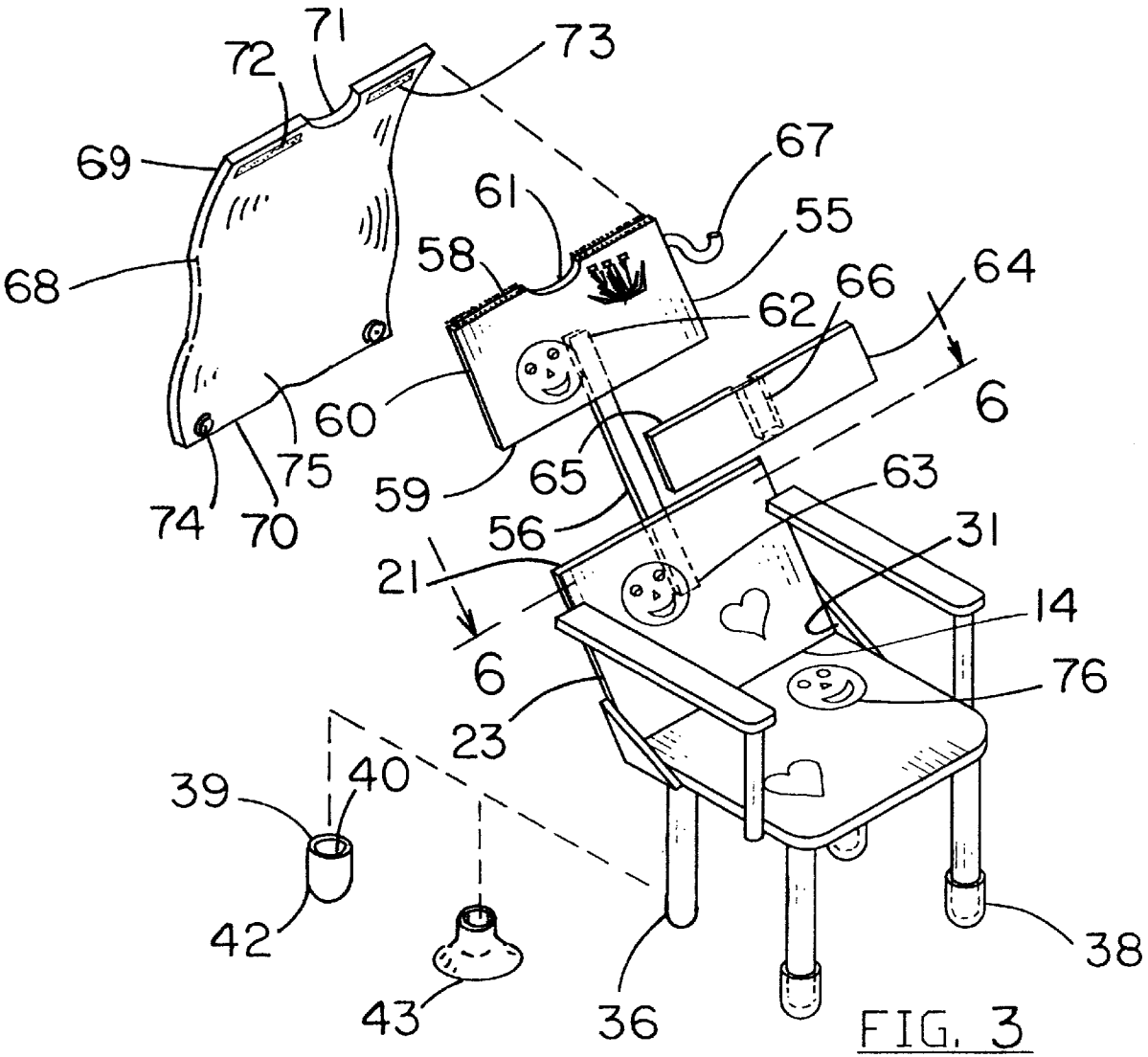
FIG. 3 is a schematic exploded view of the present invention.
Figure 5:
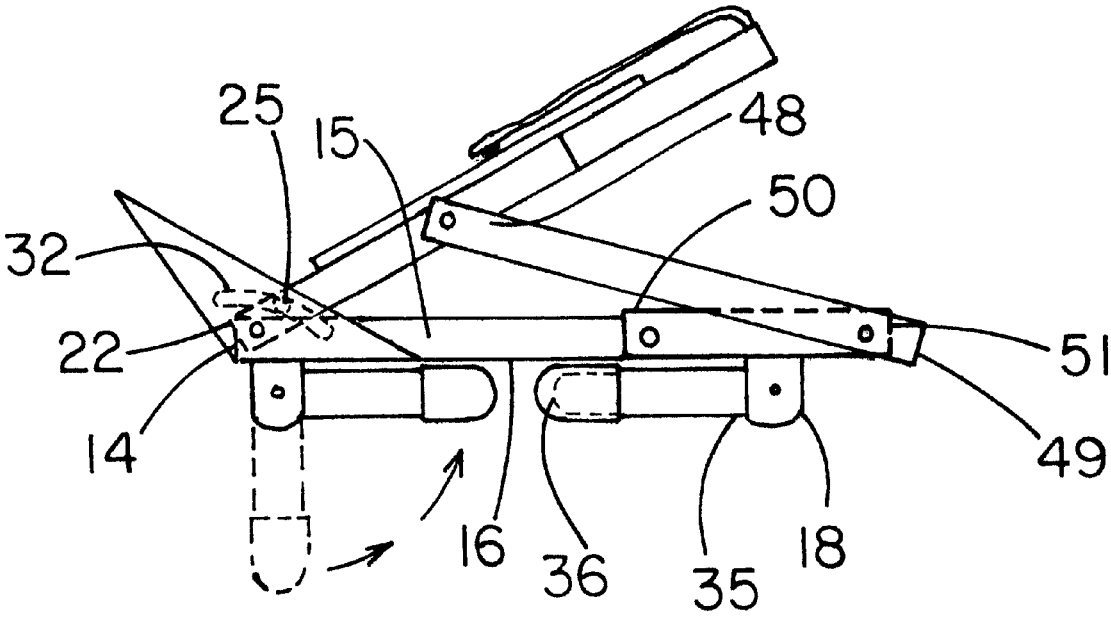
FIG. 5 is a schematic side view of the present invention in a folded position.
Figure 6:
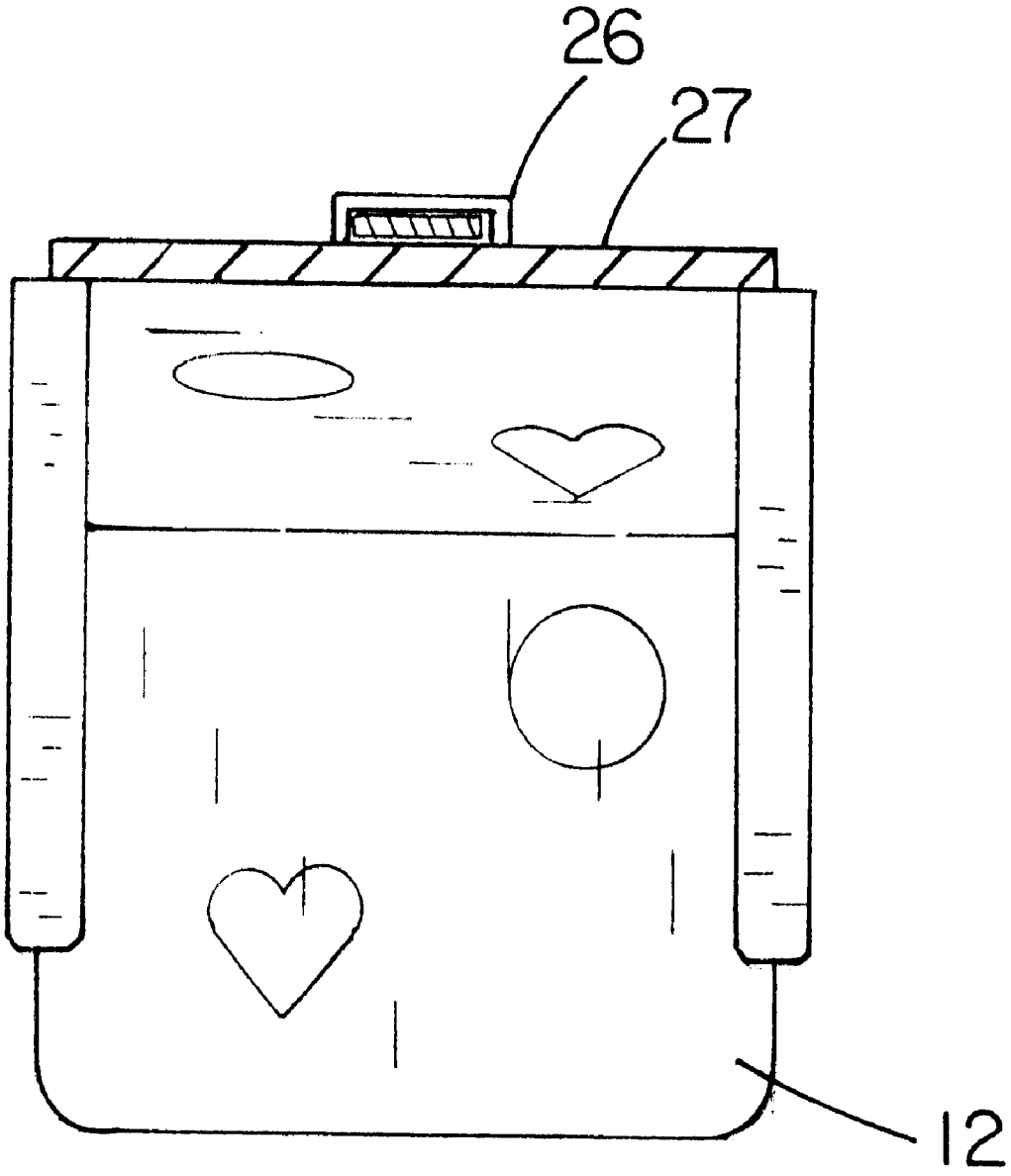
FIG. 6 is a schematic cross-sectional view of the present invention taken along line 6—6 of FIG. 3.

As illustrated in FIGS. 1 and 3, indicia 76 may be marked on the seat section 12, back section 20 and the head portion 55 for attracting and entertaining a child to sit in the chair. The indicia 76 may include figures such as, for example, smiley faces, hearts, and flowers.

Figure 2:
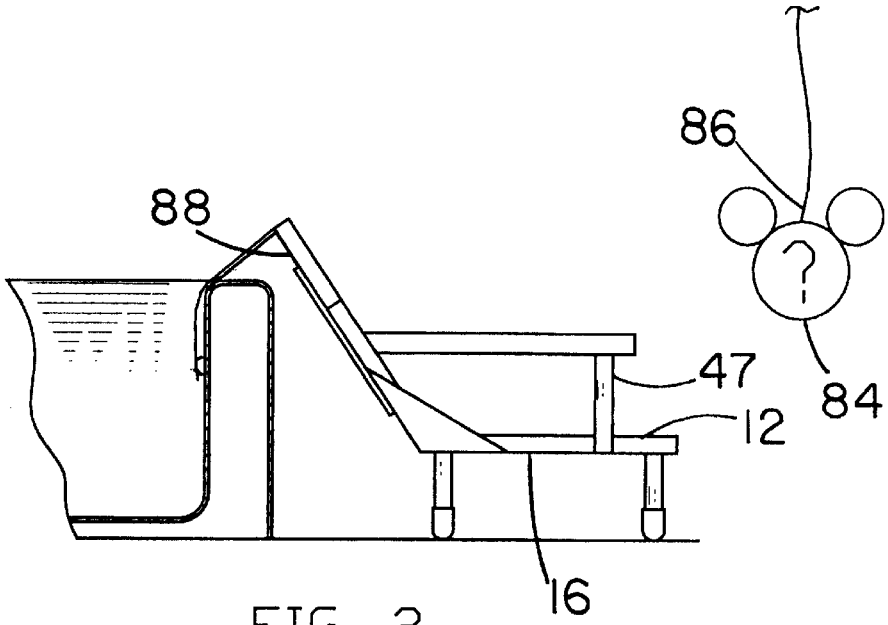
FIG. 2 is a schematic side view of the present invention positioned next to a bathtub.
Figure 4:
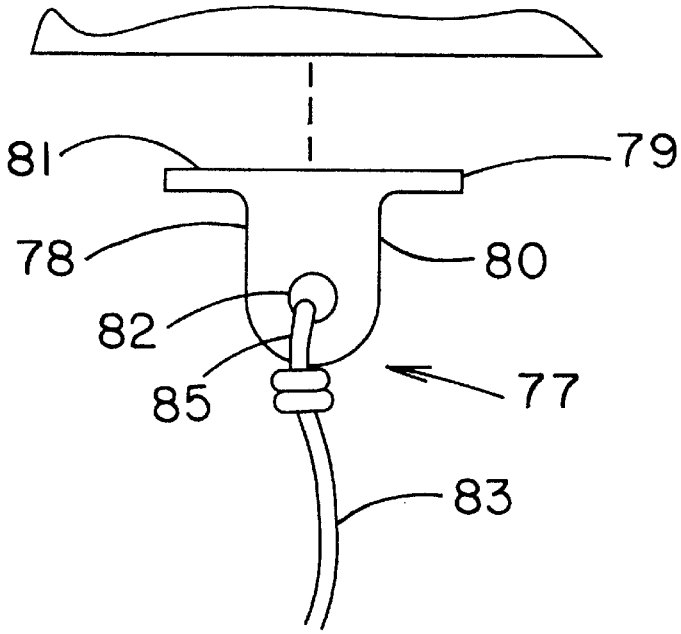
FIG. 4 is a schematic frontal view of the present invention showing a mounting assembly.

As illustrated in FIGS. 2 and 4, a toy assembly 77 may be provided for entertaining the child while seated in the seating device 10. The toy assembly 77 may include a mounting member 78 for mounting the toy assembly 77 to a wall surface or a ceiling surface. The mounting member 78 may include a mounting portion 79 and a tab portion 80 extending from the mounting portion 79. In one embodiment of the present invention, an upper surface 81 of the mounting portion 78 is mountable to the wall surface. The tab portion 79 may have a hole 82 extending therethrough for receiving a securing member 83 used for securing a toy 84, such as, for example a plush toy or action figure, to the mounting member 78. The securing member 83 preferably includes a first end 85 and a second end 86. The first end 85 of the securing member 83 is secured to the tab portion 80 and the second end 86 of the securing member 83 is removably secured to the toy 84. The securing member 83 may comprise any material such as, for example, a cord or thread material.

In use, a child sitting in the seating device 10 is amused and occupied by the toy 84 connected to the toy assembly 77. While the child is occupied his or her hair may be washed with the water running down the drape 68 and entering the bathtub. After the seating device 10 is used, it may be placed in the folded position and stored until it is needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A seating device for a child, said device being positionable generally adjacent to a bath tub for washing hair of the child, said device comprising:

a seat section for supporting a buttocks of the child;

a back section for supporting a back of the child, a lower edge of said back section being coupled to a back edge of said seat section;

a plurality of leg members for supporting said seat section above a surface, a first end of each of said leg members being coupled to said seat section;

a drape for guiding water from the child's hair into the bath tub, a first end of said drape being removably mounted on an upper edge of said back section, a second end of said drape member being removably positionable in said bath tub;

a substantially planar head section for selectively receiving a head of the child, said head section being mounted on said back section, said drape being removably mounted on said head section;

wherein said head section has a head portion and an elongated connecting portion coupled together, a first end of said connecting portion being mounted on a back surface of said head portion, a second end of said connecting portion being slidably mounted in a channel portion formed on said back surface of said back section;

wherein an upper edge of said head portion has a generally arcuate cutaway therein for supporting a neck of a child tilted in a backward direction, said drape having a generally arcuate cutaway positioned generally adjacent to said cutaway of said head portion; and a substantially planar spacer section being removably positioned between said head portion and said back section, a back surface of said spacer section having a groove therein, said connecting portion being removably mounted in said groove of said spacer section.

2. The seating device of claim 1, wherein said back section is pivotally coupled to said back edge of said seat section and positionable between an upright position and a folded position, wherein said upright position is characterized by said back section being orientated generally perpendicular to said seat section, wherein said folded position is characterized by said back section being orientated generally parallel to said seat section.

3. The seating device of claim 2, additionally including a pair of brackets for supporting said back section in said upright position, each of said brackets being mounted on one of a pair of lateral edges of said seat section.

4. The seating device of claim 3, wherein said back section has a pair of protruding portions formed on each of a pair of lateral side edges of said back section, each of said protruding portions being slidably positionable in a generally arcuate groove extending in an inner surface of each of said brackets.

5. The seating device of claim 2, additionally including a plurality of spaced ear portions formed on a lower surface of said seat section, said first end of each of each of said leg members being pivotally coupled to one of said spaced ear portions.

6. The seating device of claim 5, additionally including a plurality of caps for resisting slipping of a second end of each of said leg members with respect to a surface, each of said caps being removably mounted on said second end of each of said leg members.

7. The seating device of claim 6, wherein an end of each of said caps has an annular flange formed thereon for securing each of said caps to the surface.

8. The seating device of claim 2, additionally including a pair of arm members each for supporting an arm of the child, each of said arm members including an arm portion and a support portion being pivotally coupled together.

9. The seating device of claim 8, wherein a first end of said arm portion is pivotally coupled to a side edge of said back section, said arm portion being orientated generally parallel to said seat section, wherein a first end of said support portion being pivotally coupled to a lateral side edge of said seat section, said second ends of said arm portion and said support portion being pivotally coupled together.

10. The seating device of claim 1, additionally including a hook member being mounted on a lateral side edge of said head portion.

11. The seating device of claim 1, additionally including a fastening member for removably fastening said drape to said head portion, said fastening member having a pair of fastening portions, one of said fastening portions being mounted on said first end of said drape, one of said fastening portions being mounted on said upper edge of said head portion, each of said fastening portions being releasably coupled together.

12. The seating device of claim 1, additionally including a pair of magnets for securably mounting said second end of said drape to the bath tub, each of said magnets being mounted on an inner surface of said drape.

13. The seating device of claim 1, additionally including indicia being marked on said seat section, back section and said head portion.

14. The seating device of claim 1, additionally including a toy assembly for entertaining the child while in said chair, said toy assembly including a mounting member for mounting said assembly to a wall surface;

a securing member for securing a toy to said mounting member; and a toy for attracting the attention of the child in said chair, said toy being releasably coupled to said second end of securing member.

15. The seating device of claim 14, wherein said mounting member has a mounting portion mountable to a wall surface and a tab portion extending from said mounting portion, a first end of said securing member being secured to said tab portion.

16. A seating device for a child, said device being positionable generally adjacent to a bath tub for washing hair of the child, said device comprising:

a substantially planar seat section for supporting a buttocks of the child, said seat section having a front edge, a back edge and a pair of lateral side edges, a lower surface of said seat section having a plurality of spaced ear portions formed thereon, each of said spaced ear portions being positioned generally adjacent to a corner of said seat section;

a substantially planar back section for supporting a back of the child, said back section having an upper edge, a lower edge, a pair of side edges, said lower edge of said back section being pivotally coupled to said back edge of said seat section and positionable between an upright position and a folded position, wherein said upright position is characterized by said back section being orientated generally perpendicular to said seat section, wherein said folded position is characterized by said back section being orientated generally parallel to said seat section, said back section having a pair of protruding portions and an elongated channel portion formed thereon, wherein each of said protruding portions is formed on each of said side edges and positioned generally nearer said lower edge than said upper edge of said back section;

wherein said elongated channel portion is formed on a back surface of said back section, said channel portion extending between said upper and lower edges of said back section;

a pair of brackets for supporting said back section in said upright position, each of said brackets being mounted on one of said lateral edges of said seat section, an inner surface of each of said brackets having a generally arcuate groove therein, each of said protruding portions of said back section being slidably mounted in one of said grooves in said brackets, each of said brackets having a generally obtuse triangular shape;

a plurality of leg members for supporting said seat section above a surface, each of said leg members having a first end and a second end, said first end of each of said leg members being pivotally coupled to one of said spaced ear portions of said seat section, each of said leg members being orientated generally perpendicular to said seat section in said upright position and parallel to said seat section in said folded position;

a plurality of caps for resisting slipping of said second end of each of said leg members with respect to a surface, each of said caps being removably mounted on said second end of each of said leg members, an edge of each of said caps defining an opening into each of said caps, said second end of each of said leg members being removably inserted in one of said openings of said plurality of caps, an end of each of said caps having an annular flange formed thereon for securing each of said caps to the surface;

a pair of arm members each for supporting an arm of the child, each of said arm members including an arm portion and a support portion being pivotally coupled together;

wherein said arm portion has a first end and a second end, said first end of said arm portion being pivotally coupled to said side edge of said back section, said arm portion being orientated generally parallel to said seat section;

wherein said support portion has a first end and a second end, said first end of said support portion being pivotally coupled to said lateral side edge of said seat section, said second ends of said arm portion and said support portion being pivotally coupled together;

wherein said arm portion and said support portion are orientated generally perpendicular to each other in said upright position and parallel to each other in said folded position;

a substantially planar head section for selectively receiving a head of the child, said head section having a head portion and an elongated connecting portion coupled together;

wherein said head portion has an upper edge, a lower edge and a pair of lateral edges, said upper edge of said head portion having a generally arcuate cutaway therein for supporting a neck of a child tilting their head in a backward direction, said cutaway being positioned generally an equal distance between each of said lateral edges of said head portion;

wherein said connecting portion has a first end and a second end, said first end of said connecting portion being mounted on a back surface of said head portion, said second end of said connecting portion being slidably mounted in said channel portion;

a substantially planar spacer section being removably positioned between said lower edge of said head portion and said upper edge of said back section, a back surface of said spacer section having a groove therein, said connecting portion being removably mounted in said groove of said spacer section;

a hook member being mounted on one of said lateral side edges of said head portion, said hook member being positioned generally adjacent to said upper edge of said head portion;

a drape for guiding water from the child's hair into the bath tub, said drape having a first end and a second end, said first end of said drape being removably mounted on said upper edge of said head portion, said second end of said drape member being removably positionable in said bath tub, said first end of said drape having a cutaway therein, said cutaway of said drape being positioned generally adjacent to said cutaway in said head portion, said drape comprising a generally flexible material;

a fastening member for removably fastening said drape to said head portion, said fastening member having a pair of fastening portions, one of said fastening portions being mounted on said first end of said drape, one of said fastening portions being mounted on said upper edge of said head portion, each of said fastening portions being releasably coupled together, said fastening member comprising a hook and loop fastener;

a pair of magnets for securably mounting said second end of said drape to the bath tub, each of said magnets being mounted on an inner surface of said drape and positioned generally adjacent to said second end of said drape;

indicia being marked on said seat section, back section and said head portion;

a toy assembly for entertaining the child while in said chair, said toy assembly including:

a mounting member for mounting said assembly to a wall surface, said mounting member having a mounting portion and a tab portion extending from said mounting portion;

wherein an upper surface of said mounting portion is mountable to the wall surface;

wherein said tab portion has a hole extending therethrough;

a securing member for securing a toy to said mounting member, said securing member having a first end and a second end, said first end being secured to said tab portion, said second end of said securing member being removably secured to a toy, said securing member comprising a cord material; and a toy for attracting the attention of the child in said chair, said toy being releasably coupled to said second end of securing member.

* * * * *